United States Patent [19]

Hanssen et al.

[11] 4,408,178

[45] Oct. 4, 1983

[54] THERMOSTATIC SWITCH

[75] Inventors: Tore B. Hanssen, Hoffman Estates; Chester S. Zwirek, Elmhurst, both of Ill.

[73] Assignee: The Singer Company, Stamford, Conn.

[21] Appl. No.: 397,140

[22] Filed: Jul. 12, 1982

[51] Int. Cl.[3] ..... H01H 37/40

[52] U.S. Cl. ..... 337/320; 337/326

[58] Field of Search ..... 337/306, 309, 312, 314, 337/317, 320, 326

[56] References Cited

U.S. PATENT DOCUMENTS 3,809,835 5/1974 Watt ..... 337/320

4,262,274 4/1981 Howe et al. ..... 337/320

*Primary Examiner*—George Harris

*Attorney, Agent, or Firm*—David L. Davis; Robert E. Smith; Edward L. Bell

[57] ABSTRACT

The chamber in the metal body is filled with Freon which starts to vaporize at a temperature below the operating temperature of the switch. The vapor pressure increases substantially as the temperature rises above the refrigerant boiling point and acts against the diaphragm. The force in the diaphragm is opposed by the spring acting on the moveable seat which bears on the diaphragm pad. The pad carries a shorting bar which completes the circuit between the fixed contacts when the spring is overcome.

4 Claims, 3 Drawing Figures

THERMOSTATIC SWITCH

BACKGROUND OF THE INVENTION

To improve fuel economy of automotive engines it is desirable to run the radiator fan only when ambient conditions are inadequate to dissipate enough heat. When the radiator (or engine) temperature reaches a given valve, a temperature responsive switch closes to energize the fan motor until the temperature falls to an acceptable level. Due to various design constraints, the thermostatic switch has been inadequate to handle the electrical load of the fan motor and this has meant that a relay operated switch was required. Thus, the thermostatic switch energized the relay which then closed the motor circuit.

SUMMARY OF THE INVENTION

The object of this invention is to provide a temperature responsive switch capable of handling an inductive motor load and small enough to be mounted on an engine block or radiator.

This object is attained by a construction having an externally threaded brass body portion which contains Freon and is threaded into the engine block or radiator. A plastic housing is mounted on the brass body and contains a spring seat biased against fixed terminals by a compressed spring. The seat has a bore receiving a pin projecting from a diaphragm pad with a contact ring captured between the pad and the seat. The pad is actuated by a diaphragm captured between the body and the housing with a sealing washer on the side of the diaphragm away from the pad. When the Freon in the brass body reaches its boiling point, it starts to vaporize to force the diaphragm to actuate the pad against the force of the spring which determines the temperature at which the contact ring will bridge the terminals. The assembly is compact and offers an appreciable cost advantage.

DETAILED DESCRIPTION OF THE DRAWINGS

Figure 1:
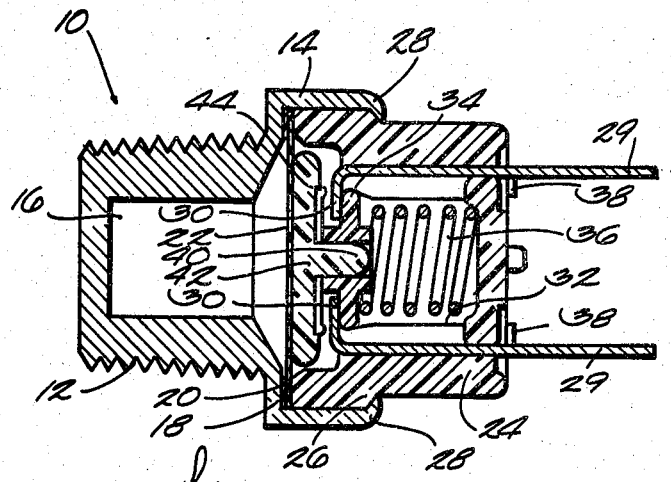
FIG. 1 is a longitudinal section through the switch.
Figure 2:
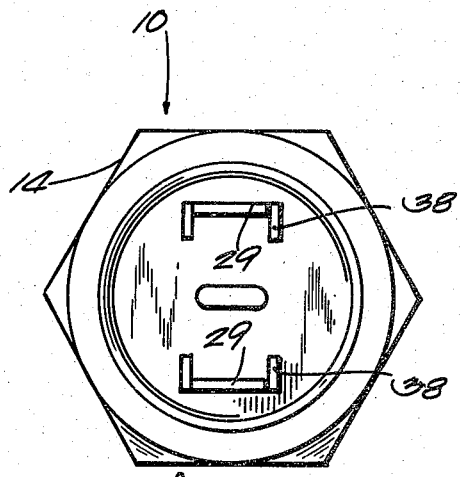
FIG. 2 is an end view with parts broken away.
Figure 3:
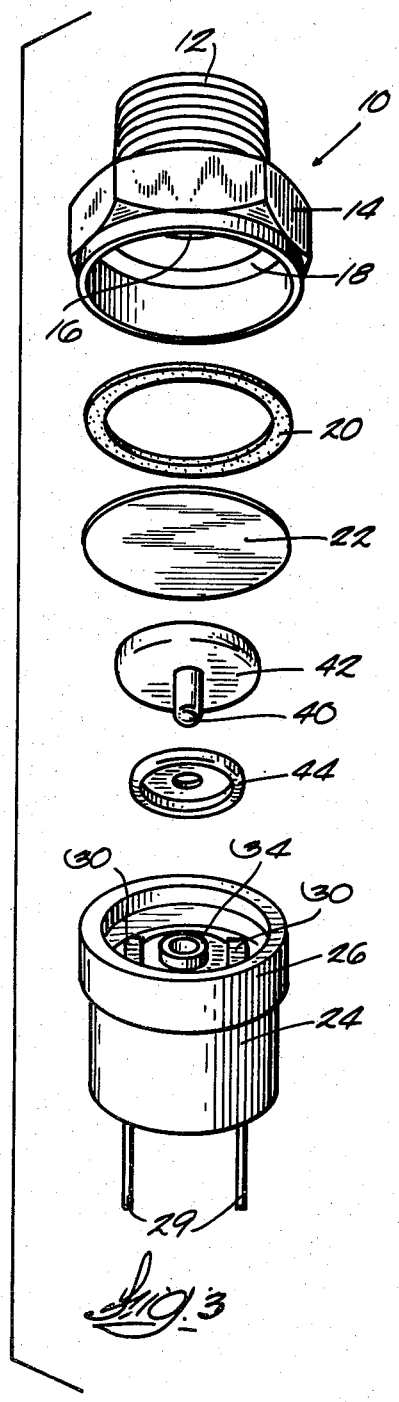
FIG. 3 is an exploded perspective view of the switch.

The switch assembly has a brass body 10 with a threaded cylindrical portion 12 adapted to be threaded into an engine block or the radiator of an automobile. The body also includes the hex flats 14 permitting a wrench to be used in driving the unit into the engine or radiator. The cavity or chamber 16 inside the brass body leads to an annular surface 18 on which a sealing washer 20 seats with the plastic diaphragm 22 positioned between the washer and the annular end surface of plastic switch housing 24. The housing has a shoulder 26 over which the edge of the brass body is crimped as at 28 to firmly hold the switch housing against the diaphragm. Two terminals 29, 29 are mounted in the housing 24. Each terminal has a formed contact 30 at the inside end bent at 90° to project into and over the central opening 32 to capture the spring seat 34 and limit movement of the seat under bias of spring 36 compressed between the seat and the end of the cavity in the housing. The long part of each terminal 29 projects through a cooperating slot in the housing and the ears 38, 38 are formed from the terminal to engage the end of the housing and lock the terminal in place. The projecting portions of the terminal, of course, are used for making connections in the electric circuit with the radiator fan.

The spring seat 34 has a central opening which receives the boss 40 projecting from the center of diaphragm pad 42. An annular shorting ring 44 is captured between the pad and extending from the spring seat. The length of the extension of the spring seat is such that when the seat abuts the contacts 30 the shorting ring 44 is spaced from the contacts 30. It will be noted the perimeter of the shorting ring is provided with a raised lip which makes contact with the fixed contacts 30 when the diaphragm pad moves against the bias of the spring far enough to make the contact.

The chamber 16 is filled with a temperature responsive liquid charge. Preferably, this is a refrigerant charge which has a boiling point which is below the temperature at which the switch is designed to operate but above normal room temperature so as to permit filling the chamber in normal factory conditions. After the chamber is filled the sealing ring and diaphragm are placed in position, and then the switch housing is put in position as a complete subassembly including the diaphragm pad. Then the brass body is crimped over the switch housing to complete the assembly. The refrigerant charge has a relatively minor pressure change with increasing temperature until the boiling point of the refrigerant is reached. In the case of R113 Freon charge, the boiling point is 117.6° F. From that point on the vapor pressure in the chamber will increase approximately ½ pound per °F. which is a relatively steep rise in vapor pressure. The force of spring 36 is selected so as to achieve the desired temperature for operation of the switch. For example, if the switch is to close in the temperature range of 180°–190° the spring force is selected to equal the force acting on the diaphragm at that temperature. To put this in simplest terms, if the diaphragm has an area of one square inch the pressure increase would be in the range of 35 to 40 pounds, and therefore, the spring would be selected to exert 35 to 40 pounds. If a higher operating temperature is desired, the spring force is increased. If it is desired to have the switch operate at a temperature lower than the boiling point of R113, another refrigerant would have to be selected having a boiling point lower than the desired operating temperature.

It has been mentioned that chamber 16 is filled with refrigerant. This is easy and convenient, but if there is any trapped air the performance will not be adversely affected. The advantage of filling the chamber is that some leakage in the course of time will not adversely affect the switch operation. All that is necessary is that some of the refrigerant remain in the liquid state at the operating temperature. Thus, the substantial loss of refrigerant can be tolerated without affecting switch performance.

In order to insure good switch life and minimize welding of the contacts both the shorting ring and the stationary contacts should be silver plated. The substantial spring force is useful in breaking any contact welding which may occur. The switches have been demonstrated to have a rated life of 100,000 cycles at a rate inductive load of 12½ amperes at 14 volts D.C. If the amperage is decreased, the life will increase.

The diaphragm is preferably made of polyimide plastic film and need not be preshaped. After assembly, however, it is desirable to condition the diaphragm by subjecting it to temperatures of 300° F. which imparts an initial stretch to the diaphragm and renders subsequent performance more stable.

We claim:

1. A temperature responsive switch assembly comprising, a heat conducting body, a switch housing mounted on the body, a diaphragm between the housing and the body, a chamber in the body on one side of the diaphragm, switch means in the housing, a diaphragm pad on the other side of the diaphragm operative to actuate the switch means, a spring opposing movement of the pad to actuate the switch in response to increasing pressure in the chamber, a temperature responsive liquid charge in said chamber having a boiling point below the temperature at which the switch is operated whereby the charge is in the liquid/vapor state at the switch operating temperature.

2. An assembly according to claim 1 in which the body is metal and has a threaded portion and a portion having flats to accept a wrench or the like.

3. An assembly according to claim 2 in which the body has an annular surface facing the housing, the edge of the diaphragm overlying the annular surface, a sealing gasket between the diaphragm and the annular surface, said housing having a rim, and said body being crimped over the rim.

4. An assembly according to claim 3 in which the spring acts against a spring seat, a pair of contacts limiting movement of the seat towards the diaphragm, said pad engaging the seat and operative to move the seat off said contacts as the pressure acting on the diaphragm overcomes the spring, and a shorting element carried by the pad engageable with said contacts to complete the electrical circuit.

* * * * *